United States Patent [19]

Morgret

[11] 4,214,745

[45] Jul. 29, 1980

[54] SAFETY GUARD FOR SHEET FEEDING MECHANISMS

[75] Inventor: Gordon L. Morgret, Baltimore, Md.

[73] Assignee: Koppers Company, Inc., Pittsburgh, Pa.

[21] Appl. No.: 933,197

[22] Filed: Aug. 14, 1978

[51] Int. Cl.[2] ..... B65H 5/06; B65H 9/04

[52] U.S. Cl. ..... 271/272; 74/612; 271/144; 271/171; 271/240

[58] Field of Search ..... 271/272, 273, 274, 171, 271/240, 144, 132, 8 R, 256; 192/130; 74/612, 608, 609; 226/199, 200; 83/546; 414/677; 198/624; 100/53

[56] References Cited

U.S. PATENT DOCUMENTS

| | | | |
|---|---|---|---|
| 1,634,088 | 6/1927 | Sieg | 271/144 X |
| 2,718,953 | 9/1955 | Pociask | 192/130 |
| 3,715,115 | 2/1973 | Grobman | 271/132 |
| 3,722,116 | 3/1973 | Beeley et al. | 192/130 X |
| 3,830,131 | 8/1974 | Wells | 83/546 X |
| 3,902,648 | 9/1975 | Keyser | 226/199 X |

*Primary Examiner*—Bruce H. Stoner, Jr.
*Attorney, Agent, or Firm*—Thomas L. Sivak; Oscar B. Brumback

[57] ABSTRACT

Disclosed is an improved safety guard for use with sheet feeding mechanisms which is disposed between the feeding mechanism and the exposed feed roll nip of a mechanism for the processing of the sheet material. The safety guard includes a non-rigid, non-elastic member which prevents an attendant from inadvertently placing his appendages in the exposed nip of feed rolls while not interfering with the passage of the sheet material from the feed mechanism to the feed rolls of the processor. The safety guard adjusts automatically and instantaneously as the width of the sheet material changes to shield the variation in exposure.

1 Claim, 2 Drawing Figures

SAFETY GUARD FOR SHEET FEEDING MECHANISMS

BACKGROUND OF THE INVENTION

1. Field of Invention

This invention relates to safety guards and, more particularly, to safety guards for sheet feeding mechanisms used in conjunction with machinery in the working of corrugated paperboard and the manufacture of boxes therefrom.

2. Description of the Prior Art

Safety guards in and of themselves are old and well known in the art. There has been one problem generally associated with prior art safety guards of all types, particularly those used with sheet feeders, that is that they normally interfere with the work in progress. This interference usually leads to the defeat of the safety guard. Machine operator and attendants would disconnect it in order to have a smooth production run. Even if the guard was specifically designed to prevent it from being disconnected, experience has shown that the guards would be tampered with, thus not only defeating their safety purpose but also, causing them to turn into greater hindrance to efficient operation. It is among the objects of the present invention to provide a safety guard which does not interfere with the smooth flow of the sheets from the feeder to the processing machinery while providing maximum safety to the appendages of the feeder attendants.

SUMMARY OF THE INVENTION

The foregoing and other objects are generally achieved by providing a safety guard which is made from a non-rigid, non-elastic material which is generally circular in cross-section. The guard is fixed to one side of the table of the sheet feeder and is directed to the top of the first vertical alignment guide of the sheet feeder through a pulley means. At the top of the first guide it is diverted horizontally to the top of the opposite vertical alignment guide where it is directed vertically by pulley means to the bottom of the guide. The guard is then directed through pulley means at the bottom of the guide to be fixed at the side of the table of the sheet feed mechanism. Sheets of paperboard material are fed to the processing machinery between the vertical side guides. When the sheets are between the side guides, the guards cover all of the exposed nip of the feeder rolls outside the side guide preventing the accidental insertion of appendages therein. The guard automatically adjusts to cover the amount of exposed nip when the distance between the side guides is varied. The foregoing will more fully appear in the following detailed description of the specification when read in conjunction with the accompanying drawings.

DESCRIPTION OF THE PREFERRED EMBODIMENT

Figure 1:
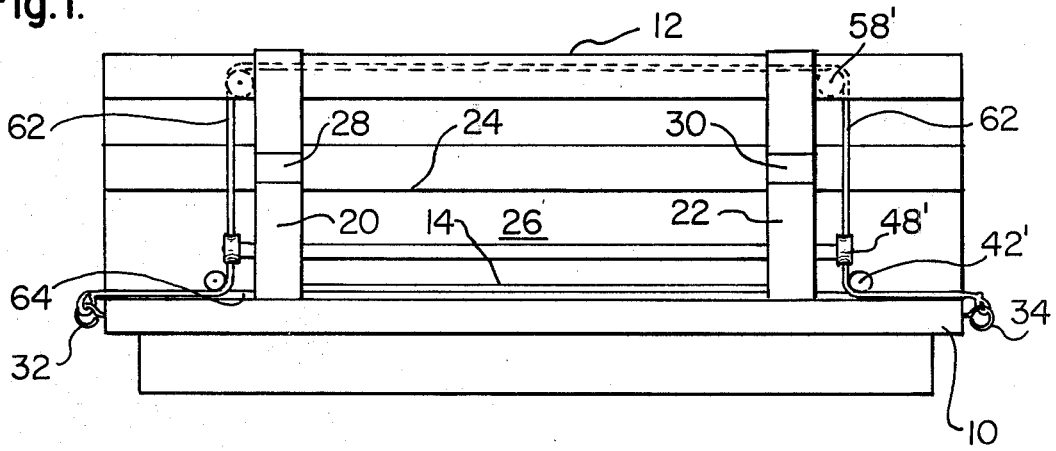
FIG. 1 is a front elevational view partly in section of a sheet feeder incorporating the safety guard of the present invention.

Sheet feeders for serially feeding paperboard or like blanks to creasing, slotting, folding or other processing machinery are generally old and well known in the art.

Such sheet feeding mechanisms are described in detail in the U.S. Pat. Nos. 3,105,681 and 3,994,490, which are incorporated by reference herein to the extent it is necessary to understand the safety guard of the present invention. Since the description of a sheet feeding mechanism to which the preferred embodiment of the present invention is adapted is complete in U.S. Pat. Nos. 3,105,681 and 3,994,490, only those parts of such a mechanism which are essential to the description of the present invention will be described herein.

Referring to the drawings, the table 10 of a mechanism generally designated 12 for feeding a stack of paperboard blanks 14 through feed rolls 16 and 18 of machinery which will further process the paperboard blanks. Sheet feeding mechanism 12 has a pair of vertical alignment guides 20 and 22 which are adapted to slidably engage a shelf 24 of back plate 26 through brackets 28 and 30. Guides 20 and 22 are moved over shelf 24 to vary the distances between them and thereby provide for the accommodation of blanks of various widths. The movement of guides 20 and 22 can be accomplished either manually or through a drive screw arrangement, which is well known and understood in the art.

Figure 2:
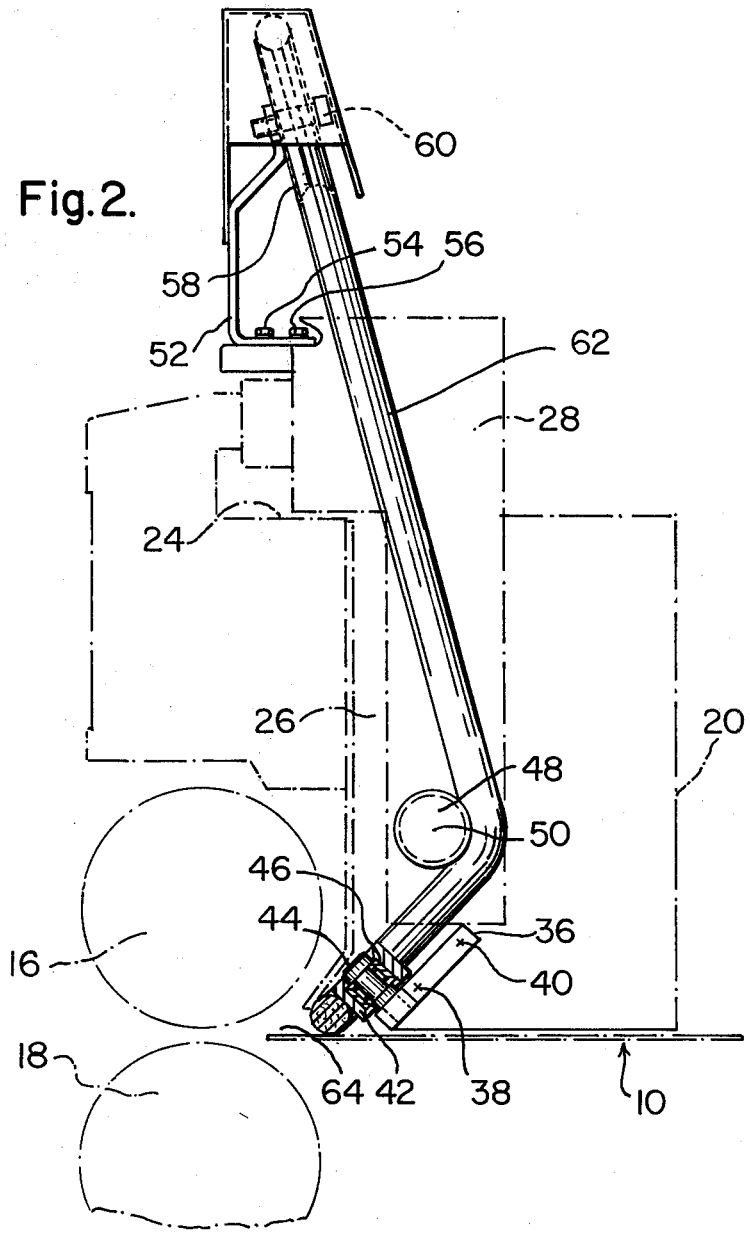
FIG. 2 is a side elevational view partly in section of the safety guard of the present invention.

Fixed to one side of table 10 is an anchor means such as eyebolt 32. A similar anchor 34 is fixed to the other side of the table. Referring to FIG. 2 which shows a side view of guide 20 support bracket 36 is mounted to guide 20 by conventional bolts 38 and 40. Rotatably mounted on bracket 36 is roller 42 which rotates about bolt fastener 44 through bearing 46. Upstream of roller 42 is sheave 48 which is rotatably mounted on guide 20 about bolt 50 which serves as an axle for sheave 48. Bracket arm 52 is mounted to bracket 28 of guide 20 through bolts 54 and 56. Sheave 58 is rotatably mounted to arm 52 through bolt 60. The structure of guide 22 is a mirror image of guide 20. It also includes a roller 42', sheave 48' and sheave 58'

Guard rope 62, which is twisted hemp rope approximately 1 inch in diameter, is fixed to eyebolt 32 mounted on the side of table 10. Rope 62 in the following description is continous in length. Rope 62 extends from eyebolt 32 across the nip 64 of the feed roller 16 and 18 under roller 42, up on sheave 48, over sheave 58 to sheave 58', down to sheave 48', under roller 42' and to eyebolt 34. It can be seen from the foregoing that no matter what the position of guides 20 and 22 when the sheet feeder is in operation, and there are blanks stacked for feeding between the guides, and being fed through well-known vacuum suction means to the fed rolls of the processing machinery there is no exposed feed roll nip into which an attendant's appendages can be trapped. Likewise, it is evident that the guard automatically adjusts where the guides are adjusted. While I have described a certain preferred embodiment of my invention, it will be understood that it may be otherwise embodied with the scope of the following claims.

What is claimed:

1. In an apparatus for serially feeding sheets of material to the feed rolls of machinery adapted to further process the material, said apparatus including a table means for supporting said sheets prior to feeding and a pair of side guide means for aligning said sheets therebetween prior to feeding, the improvement comprising:

a guard means for restricting access to the nip of said rolls outward the sheets within said guide means, the guard means including:

(i) anchor means fixed to a first side of said table means, (ii) a continuous spiral rope member fixed to said anchor means, (iii) a plurality of rope receiving means rotatably mounted on the first one of said side guide means, said rope receiving means adapted to conduct said rope the height of said side guide means, (iv) a plurality of rope receiving means mounted on said second side guide means, said rope receiving means on said second side guide means adapted to receive said rope from said first side guide means to conduct said rope the height of said second side guide means; and (v) second anchor means fixed to a second side of said table means, said second anchor means adapted to fixably receive said rope; said anchor means and said rope receiving means on said guide means positioning said rope member opposite the nip outward the sheets within said guide means to restrict access to the nip.

* * * * *